US009808820B2

(12) United States Patent
Rouaud et al.

(10) Patent No.: US 9,808,820 B2
(45) Date of Patent: Nov. 7, 2017

(54) AUTOMATIC PAINTING AND MAINTAINING WET-SURFACE OF ARTIFACTS

(71) Applicant: ABB Technology AG, Zurich (CH)

(72) Inventors: Didier Rouaud, Bloomfield Hills, MI (US); Michael G. Nelson, Oxford, MI (US); Srinivas Nidamarthi, Auburn Hills, MI (US)

(73) Assignee: ABB Schweiz AG, Baden (CH)

( * ) Notice: Subject to any disclaimer, the term of this patent is extended or adjusted under 35 U.S.C. 154(b) by 415 days.

(21) Appl. No.: 14/263,202

(22) Filed: Apr. 28, 2014

(65) Prior Publication Data

US 2014/0329001 A1 Nov. 6, 2014

Related U.S. Application Data

(60) Provisional application No. 61/819,132, filed on May 3, 2013.

(51) Int. Cl.

| | |
|---|---|
| ***B05B 12/00*** | (2006.01) |
| ***B05B 12/08*** | (2006.01) |
| ***B05B 12/02*** | (2006.01) |
| ***B05B 13/04*** | (2006.01) |
| ***B05C 9/06*** | (2006.01) |
| ***B05D 7/00*** | (2006.01) |

(52) U.S. Cl.

CPC ..... *B05B 12/084* (2013.01); *B05B 12/02* (2013.01); *B05B 13/0431* (2013.01); *B05C 9/06* (2013.01); *B05B 13/0452* (2013.01); *B05B 13/0457* (2013.01); *B05D 7/542* (2013.01)

(58) Field of Classification Search

CPC ..... B05B 12/084; B05D 7/542

See application file for complete search history.

(56) References Cited

U.S. PATENT DOCUMENTS

| | | | |
|---|---|---|---|
| 4,977,000 | A | 12/1990 | Murayama et al. |
| 5,633,037 | A | 5/1997 | Mayer |
| 5,989,643 | A | 11/1999 | Nakagawa et al. |
| 6,234,405 | B1 | 5/2001 | Yoshida et al. |

(Continued)

FOREIGN PATENT DOCUMENTS

| | | |
|---|---|---|
| DE | 4009000 | 9/1991 |
| DE | 102011010505 | 8/2012 |

(Continued)

OTHER PUBLICATIONS

European Search Report, EP101466387.2, dated Feb. 9. 2015, ABB Technology AG, 15 pgs.

*Primary Examiner* — James M Mellott

(74) *Attorney, Agent, or Firm* — Taft Stettinius & Hollister LLP

(57) ABSTRACT

A system and method of coating a workpiece is disclosed. A controller is in electronic communication with a robotic manipulator having a coating dispenser. A layer of coating is applied to a surface of the workpiece by the robot. A wet-surface time is determined corresponding to the areas of the surface upon which the layer of coating is applied. A second layer of coating is applied prior to the expiration of the wet-surface time of the first layer. The layers of coating in adjacent segments can be applied in an overlapping manner within the boundary regions of the segments.

16 Claims, 9 Drawing Sheets

(56) References Cited

U.S. PATENT DOCUMENTS

| | | | | |
|---|---|---|---|---|
| 6,533,861 | B1 | 3/2003 | Matsuda et al. | |
| 7,039,500 | B2 | 5/2006 | Milojevic et al. | |
| 7,429,298 | B2 | 9/2008 | Krogedal et al. | |
| 7,643,907 | B2 | 1/2010 | Fuhlbrigge et al. | |
| 7,975,645 | B2 | 7/2011 | Umezawa et al. | |
| 8,050,799 | B2 | 11/2011 | Eickmeyer et al. | |
| 2002/0069822 | A1* | 6/2002 | Dattilo | B05B 12/1418 118/612 |
| 2002/0168479 | A1 | 11/2002 | Manning et al. | |
| 2007/0275220 | A1* | 11/2007 | Nagase | B05D 1/305 428/220 |
| 2009/0074947 | A1 | 3/2009 | Takeuchi | |
| 2009/0104357 | A1* | 4/2009 | Dattilo | B05D 7/57 427/331 |
| 2014/0052294 | A1 | 2/2014 | Herre | |
| 2014/0220231 | A1 | 8/2014 | Fischer et al. | |

FOREIGN PATENT DOCUMENTS

| | | | | |
|---|---|---|---|---|
| DE | 102011114382 | | 3/2013 | |
| EP | 0341134 | A1 | 11/1989 | |
| EP | 1754545 | | 2/2007 | |
| JP | EP 1754545 | A1 * | 2/2007 | B05B 12/084 |
| WO | 2007101475 | A1 | 9/2007 | |
| WO | 2009146936 | | 10/2009 | |
| WO | WO 2009146936 | A1 * | 12/2009 | B05B 13/0431 |

* cited by examiner

AUTOMATIC PAINTING AND MAINTAINING WET-SURFACE OF ARTIFACTS

FIELD OF INVENTION

The present disclosure concerns systems and methods for automatic spray coating of large workpieces, and in particular robotically applied sprayed coatings of large workpieces.

BACKGROUND

Some examples of large artifacts that can require painting or other material coating include aircraft wings, aircraft fuselages, aircraft engine blades, wind-turbine blades, wind-tower shafts, artifacts concerning space and defense industries such rocket and missile bodies, commercial and transportation truck bodies, rail vehicles and boats.

The surfaces of such artifacts that require coating can include surfaces that have complex features including but not limited to 3-dimensional surface shapes, uneven adjacent surfaces, tapered or wedge shapes and other shapes. Such large and complex surfaces can require coating or painting with several layers of material. Further, successive coats can be of the same or different materials, and can have varying thicknesses.

Due to the characteristics of some coatings, proper application of certain coats should be performed when the underlying coating is still sufficiently wet. For example, this is required when bonding between layers occurs only when the underlying coat is sufficiently wet upon application of the subsequent overlying coat. Unless such application is made while the underlying surface is sufficiently wet, the quality of the overall coating is diminished.

SUMMARY

A system and method of coating a workpiece is disclosed. A controller is in electronic communication with a robotic manipulator having a coating dispenser. A layer of coating is applied to a surface of the workpiece by the robot. A wet-surface time is determined corresponding to the areas of the surface upon which the layer of coating is applied. A second layer of coating is automatically applied prior to the expiration of the wet-surface time of the first layer. The layers of coating in adjacent segments can be applied in an overlapping manner within the boundary regions of the segments.

BRIEF DESCRIPTION OF THE DRAWINGS

In the accompanying drawings, structures and methods are illustrated that, together with the detailed description provided below, describe aspects of a system and method for coating large and complex artifacts. It will be noted that a single component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
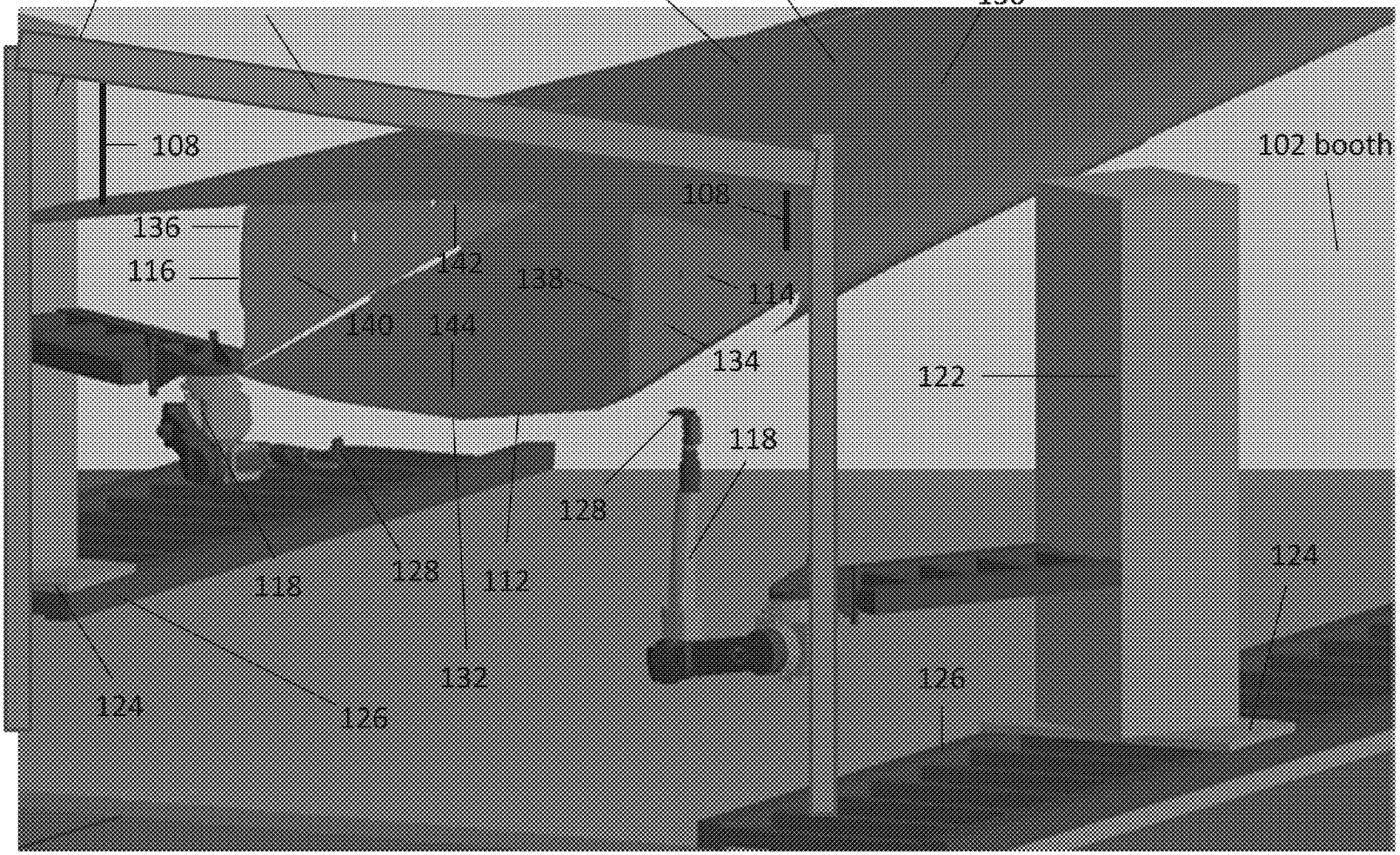
FIG. 1 illustrates a partial perspective view of a coating system 100.

FIG. 1 illustrates a partial perspective view of a coating system 100 according to one aspect of the present teachings. The coating system 100 includes a booth 102 that encloses a volume 103 in which the workpiece 104 is disposed during the coating process. The illustrated workpiece 104 is a partially assembled wing of a commercial aircraft. Other structures can serve as workpieces 104. Some examples of such structures include but are not limited to aircraft wings, fuselages, engine nacelles, windmill turbine blades, rockets and other large, complex structures. While a booth 102 can be desirable, the volume in which the workpiece 104 is held during the coating process according to the present disclosure need not be a dedicated booth 102, but instead can be any volume sufficient to hold the coating system 100 and workpiece 104. The workpiece 104 is suspended from supports 106, 107 through wires 108. The illustrated supports 106, 107 include overhead cranes. The workpiece 104 is suspended from the supports 106, 107 through wires 108. The supports 106, 107 can hold the workpiece 104 in a variety of positions within the booth 102. For example, the workpiece 104 can be rotated, lifted or lowered. The workpiece 104 can also be fixed in a particular position throughout all or part of the coating process.

Various forms of coatings can be applied to workpieces according to the present teachings, including epoxy-based or urethane-based primers and paints, examples of which are coatings qualified under the SAE standard AMS 3095. Other examples of coatings that can be implemented according to the present teachings are automotive and industrial paints and primers, coatings on which additional layers are applied while still sufficiently wet and coatings applied on a base layer that is sufficiently wet.

The workpiece 104 has several surfaces that can require coating, such as the surfaces of the upper skin panel 110, lower skin panel 112, the front spar 114 and rear spar 116.

Robots 118*a,b* are disposed within the booth 102 and are secured to arms 120*a,b* that extend from towers 122*a,b*. Two articulated robots 118*a,b* are illustrated in FIG. 1. However, a single robot 118 or more than two robots 118 can be implemented. In addition to articulated robots 118, other forms of programmable manipulators can also be implemented according to the present teachings. Available manipulators include but are not limited to linear-type robots and delta-type robots. With reference to FIG. 1, the arms 120*a,b* are moveably secured to towers 122*a,b*, permitting vertical movement of the arms 120*a,b* relative to the towers 122*a,b*. Such motion can be affected by use of, for example, a motorized sprocket and track system, pneumatic actuators or other devices. The vertical motion afforded the robots 118 permits easier access to the top and bottom of the workpiece 104, such as can be required when painting the upper surface of the upper skin panel 110 or the lower surface of the lower skin panel 112. The towers 122*a,b* are each rotatably mounted to one of tower bases 124*a,b*. The tower bases 124*a,b* themselves have motorized wheels permitting movement along tracks 126*a,b*. Motion of the towers 122*a,b* can be affected by other mechanisms, such as by mounting one or both of the towers 122*a,b* to mobilized carts. In order to coordinate the motion of such a cart relative to a workpiece 104, tracking of the position of the workpiece 104 and the instantaneous position of the cart and any robots 118 mounted thereon could be performed. Such tracking can be performed by cameras mounted within the booth 102 or by sensors placed on the moveable carts or otherwise mounted within the booth 102 that are able to detect the relative position of the cart having the robot 118 within the volume in which the workpiece is held during the painting process. Precisely determining the position and orientation of a robot 118 mounted to such a movable cart can assist in applying coating according to a specified pattern on the workpiece 104. Coating dispensers 128*a,b* are mounted on the ends of the illustrated articulated robots 118*a,b,* which allow precise, accurate and consistent motion of the dispensers 128*a,b* relative to the workpiece 104.

The combination of the range of motion of the robots 118*a,b,* the vertically moveable arms 120*a,b* and the rotatable, moveable towers 122*a,b* allow the system 100 to position the coating dispensers 128*a,b* in all of the positions required to completely coat the surfaces of workpiece 104. Such coatings can include primer coats, top coat, clear coats or other forms of coatings. According to other aspects of the present teachings, the robots 118*a,b* can be fitted with finishing tooling. For example, in lieu of having coating dispensers 128*a,b* mounted to the robots 118*a,b,* the robots 118*a,b* can instead be fitted with a sander, pressure washer fitting or other tooling that can be required to prepare the workpiece 104 surfaces for coating or painting.

Figure 2:
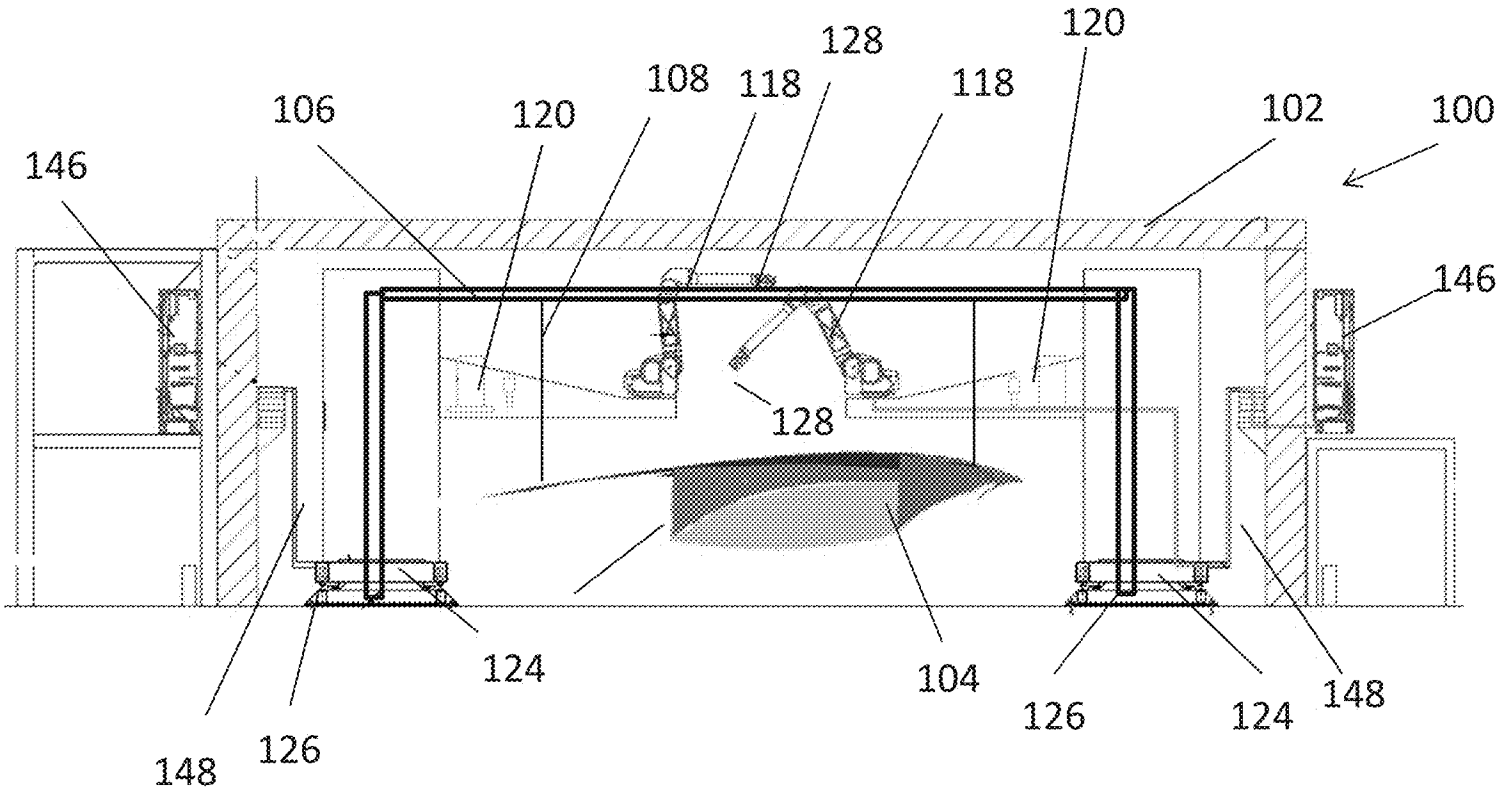
FIG. 2 illustrates an elevation view of coating system 100.

FIG. 2 shows a side view of coating system 100. The height of the wing 104 within the booth 102 can be changed during the coating process to permit the robots 118*a,b* to access the various surfaces of the workpiece 104. In FIG. 2, the workpiece 104 is disposed at a relatively low position, allowing the robots 118*a,b* to access the outer surface 130 of the upper skin panel 110. In other arrangements, the workpiece 104 can be disposed relatively higher within the booth 102 during the coating process, allowing the allowing the robots 118*a,b* to access the outer surface 132 of the lower skin panel 112, the outer surface 134 of the front spar 114 and outer surface of the rear spar 116. Internal surfaces can also be coating according to the present disclosure. For example, the inner surface 138 of the front spar 114, inner surface 140 of the rear spar 116, inner surface 142 of upper skin panel 110 and the inner surface 144 of lower skin panel 112 can be coated according to the present teachings. Robots 118*a,b* can access the interior surfaces through, for example, openings in the lower skin panel 112. Such openings permit the robots 118*a,b* to insert the coating dispensers 128*a,b* into the workpiece 104, apply coating to the interior surfaces of the workpiece 104 and remove the dispensers 128*a,b* from the interior of the workpiece 104.

Controllers 146*a,b* are in electrical communication with robots 118*a,b* through physical connections 148*a,b*. While physical connections are shown, wireless connections can also be implemented according to the present disclosure. The controllers 146*a,b* can include, for example, a central processing unit that executes computer-readable instructions stored on a non-transient medium and a power supply for the individual robots 118*a,b* and their corresponding dispensers 128*a,b*. According to other aspects of the present teachings, the illustrated robots 118*a,b* can be connected to a single controller that provides the functionality of the two individual controllers 146*a,b* illustrated in FIG. 2. According to still other aspects of the present teachings, one or more controllers 146 can be implemented with the coating dispensing robots 118. In one example, one controller 146 can be connected to two or more dispensing robots 118. According to yet other aspects of the present teachings, redundant controllers 146 can be connected to one or more of the dispensing robots 118.

Figure 3:
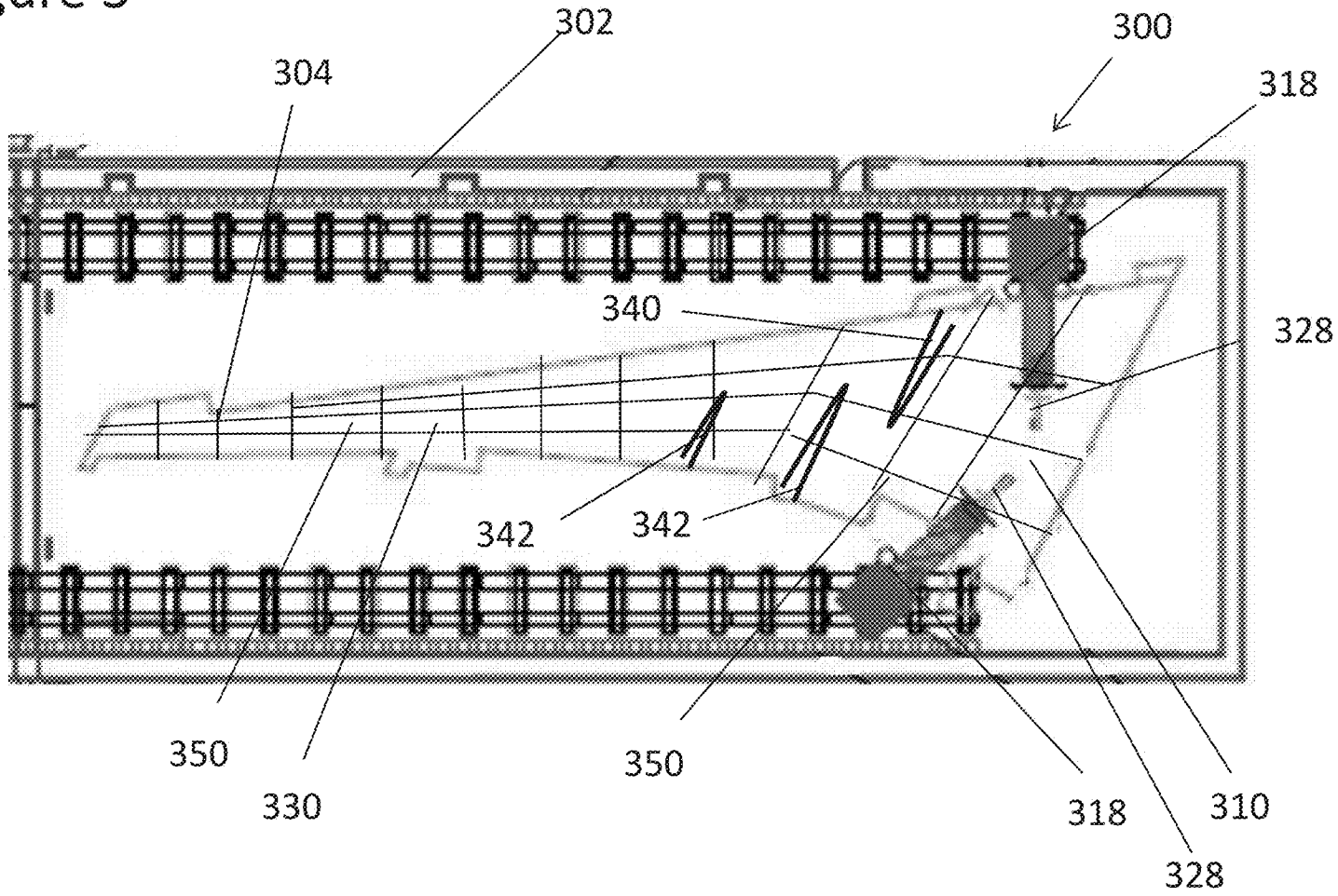
FIG. 3 illustrates a plan view of coating system 100.

With reference to FIG. 3, the coating system 100 is shown without supports 106, 107 and wires 108 for clarity. According to one aspect of the present teachings, the outer surface 130 of the upper skin panel 110 of the workpiece 104 is divided into several separate segments 350 upon which one or more layers of coating are applied. The selection of the shape and size of the segments 350 is based in part upon the location of the segment 350 on the workpiece 104 relative to the location and available reach of the coating dispensers 128*a,b* found at the ends of robots 118*a,b*.

According to one aspect of the present teachings, one or more robots such as robots 118*a,b* can be implemented to apply layers of coating on the workpiece. Where one robot 118 is utilized, multiple different layers of material can be deposited on the workpiece 104 by switching the coating provided by a dispenser such as dispensers 128. Where multiple robots 118 are implemented, any particular layer within a surface area of the workpiece 104 surface can be applied by any of the multiple robots 118 with access to the surface area and able to apply the necessary coatings at the required time. According to one aspect of the present teachings, one of the robots 118*a,b* can apply a complete layer of coating over one or more of the segments 350. According to still other aspects of the present teachings two or more robots 118*a,b* apply a complete layer of coating over one or more of the segments 350. Under certain circumstances, one or more robots 118*a,b* can reach the entirety of a particular segment 350, allowing for flexibility in determining which robots 118*a,b* will be assigned to apply the particular layers of coatings of the particular segments 350.

The selection of the shape and size of the segments 350 is also based in part on the amount of time required for one or more of the layers of coating to dry. In particular, the size and shape of the segments 350 can be selected such that the robots 118*a,b* and associated coating dispensers 128*a,b* can complete an application of a layer of coating within a segment 350 before any of the portions of the particular layer within the segment 350 dry such that a required wet-surface is not maintained in the segment 350. The duration from the point in time at which coating is first applied to a portion of the surface to the point in time at which the coating at that portion is too dry to apply a desired subsequent coat can be denoted as the wet-surface time duration or $T_{WET}$. Such a parameter can depend upon, for example, the chemical composition of the layer of coating, the ambient temperature, atmospheric pressure and humidity, the temperature of the workpiece, the thickness of the layer of coating and other factors.

The speed at which the applicators can apply coating will depend on the shape of the surface. The presence of, for example, pylons 340, flap track fairings 342, 343 or other contours can affect the duration of time required to completely coat a segment 350 of the workpiece 104. For segments 350 of the workpiece 104 that have such relatively complex three-dimensional shapes, the parameters under which coating is applied can change, such as the flow rate of coating material, the spray pattern and the speed of motion of the dispensing robot 118. As just one example, when a complex surface is encountered, the flow rate of coating material from the dispenser 128 can decrease, the spray pattern shape can be narrowed so to cover less area per unit time and the rate of translational movement of the dispenser 128 relative to the segment 350 can decrease to ensure sufficient coating thickness is achieved. Other parameters can affect the speed, and therefore the time required to apply one or more layers of coating. Such parameters include but are not limited to the required coating thickness and the rate of flow of coating material from the dispenser 128.

Figure 4:
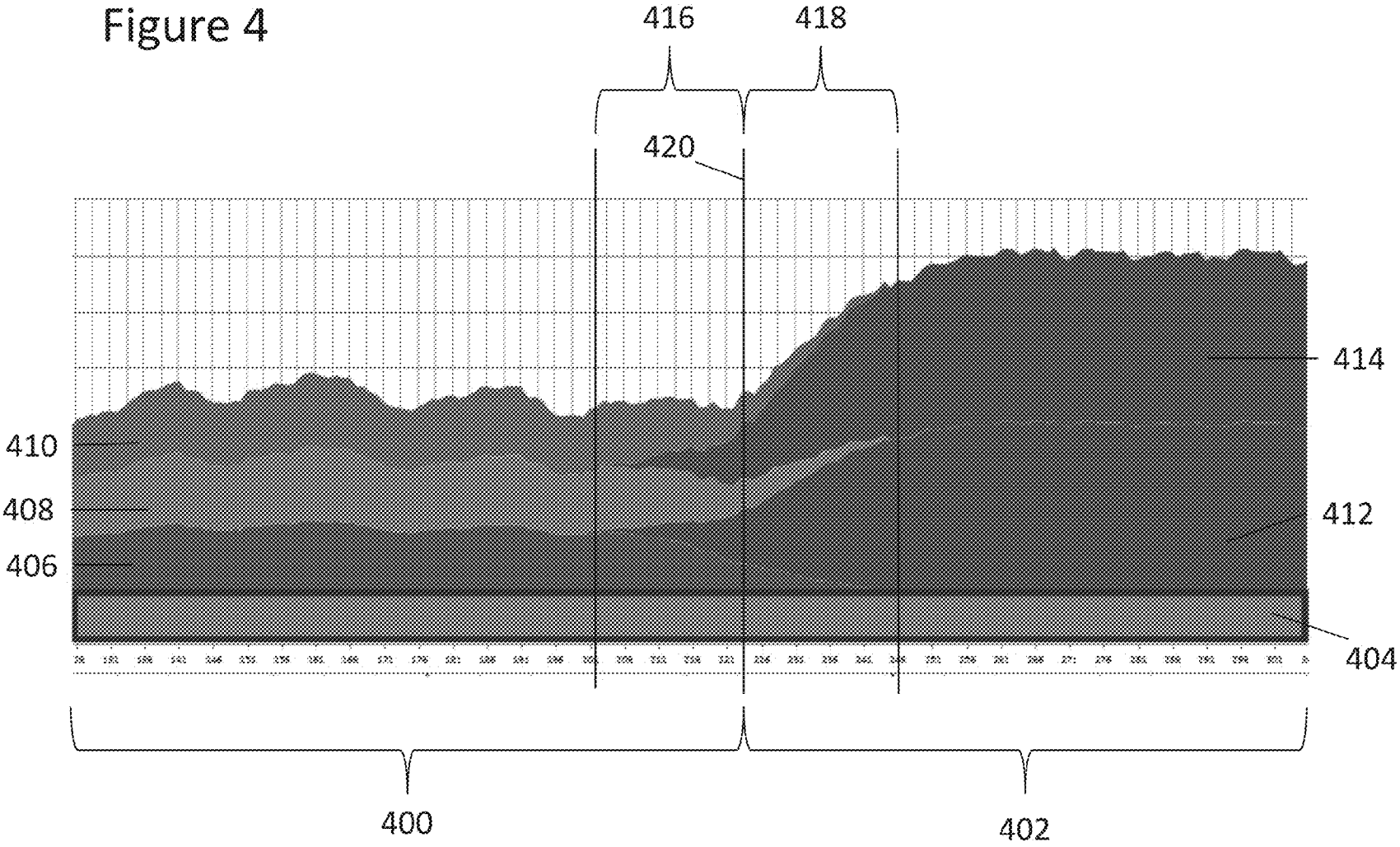
FIG. 4 illustrates a cross-sectional view of two adjacent segments 400, 402 of coating.

As shown in FIG. 4, two adjacent segments 400, 402 of a workpiece 404 are coated with multiple layers that differ in their compositions and thicknesses. Layers can differ in their composition by having different relative amounts of the same constituent materials, or a different mixture including entirely different constituents. Segment 400 is coated with a primer layers 406, intermediate layer 408 and top layer 410, while segment 402 is coated with a primer layer 412 and top layer 414.

According to one aspect of the present teachings, one or more robots 118 can be implemented to apply layers of coating such as those shown in FIG. 4. For example, each of the layers applied to segments 400 and 402 can be applied by the same robot 118. According to another aspect of the present teachings, one robot 118 applies the layers 406, 408 and 410 to segment 400, while another robot 118 applies layers 412 and 414 to segment 402. According to yet another aspect of the present teachings, different robots 118 apply each of the five layers shown in FIG. 4.

With further reference to FIG. 4, the layers on adjacent segments 400, 402 are blended together, overlapping within the boundary region of the segments 400, 402. Layer 406 is applied first and completely covers segment 400. The thickness of layer 406 is tapered within the boundary region 416 of segment 400. Layer 406 extends into the boundary region 418 of segment 402, and its thickness diminishes as the distance from segment 400 increases. Layer 412 is applied next by the same robot 118 or different robot 118 than applied layer 406. Layer 412 completely covers segment 402 and its thickness begins to taper off within the boundary region 418 of segment 402. Layer 412 extends into the boundary region 416 of segment 400, and its thickness continues to diminish as the distance from segment 402 increases. Intermediate layer 408 is applied next over segment 400 and overlaps with primer layer 412 within the boundary region 418 of segment 402 and boundary region 416 of segment 400. Top layer 414 is applied next, followed by top layer 410.

Figure 5:
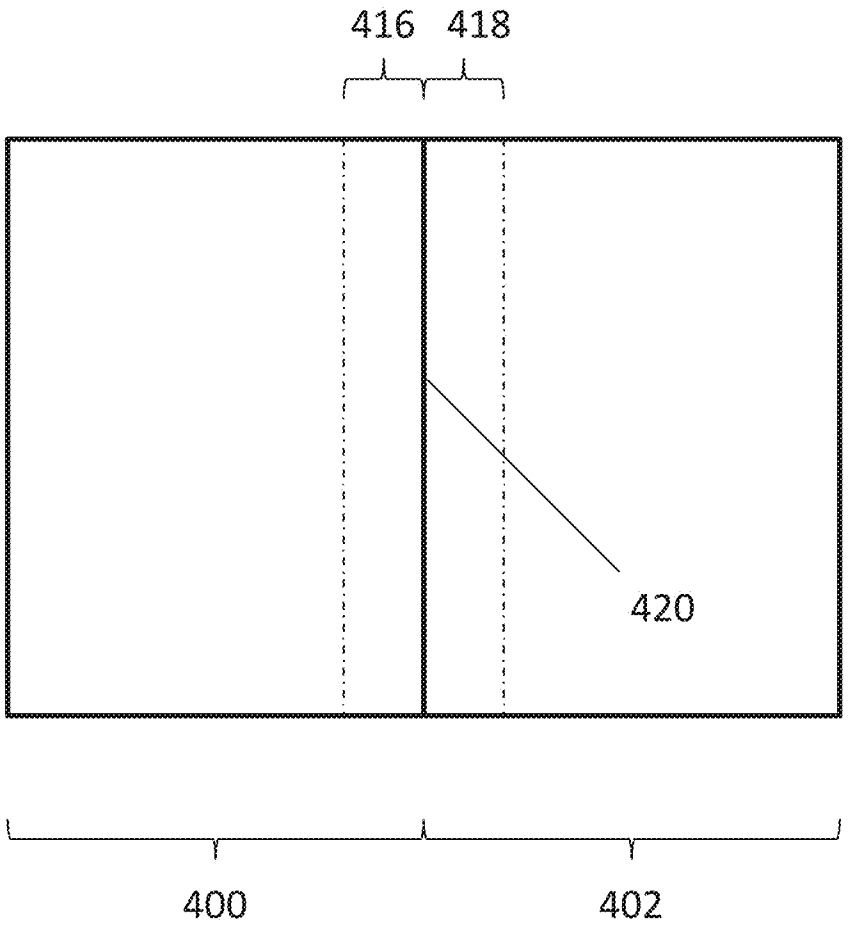
FIG. 5 illustrates a diagrammatic view of the segments 400, 402 shown in FIG. 4.

As shown in FIGS. 4 and 5, segments 400, 402 are separated by a linear boundary line 420. Application of coating layers with robots according to the present teachings permits precise application of coating such that masking is not required.

Figure 6:
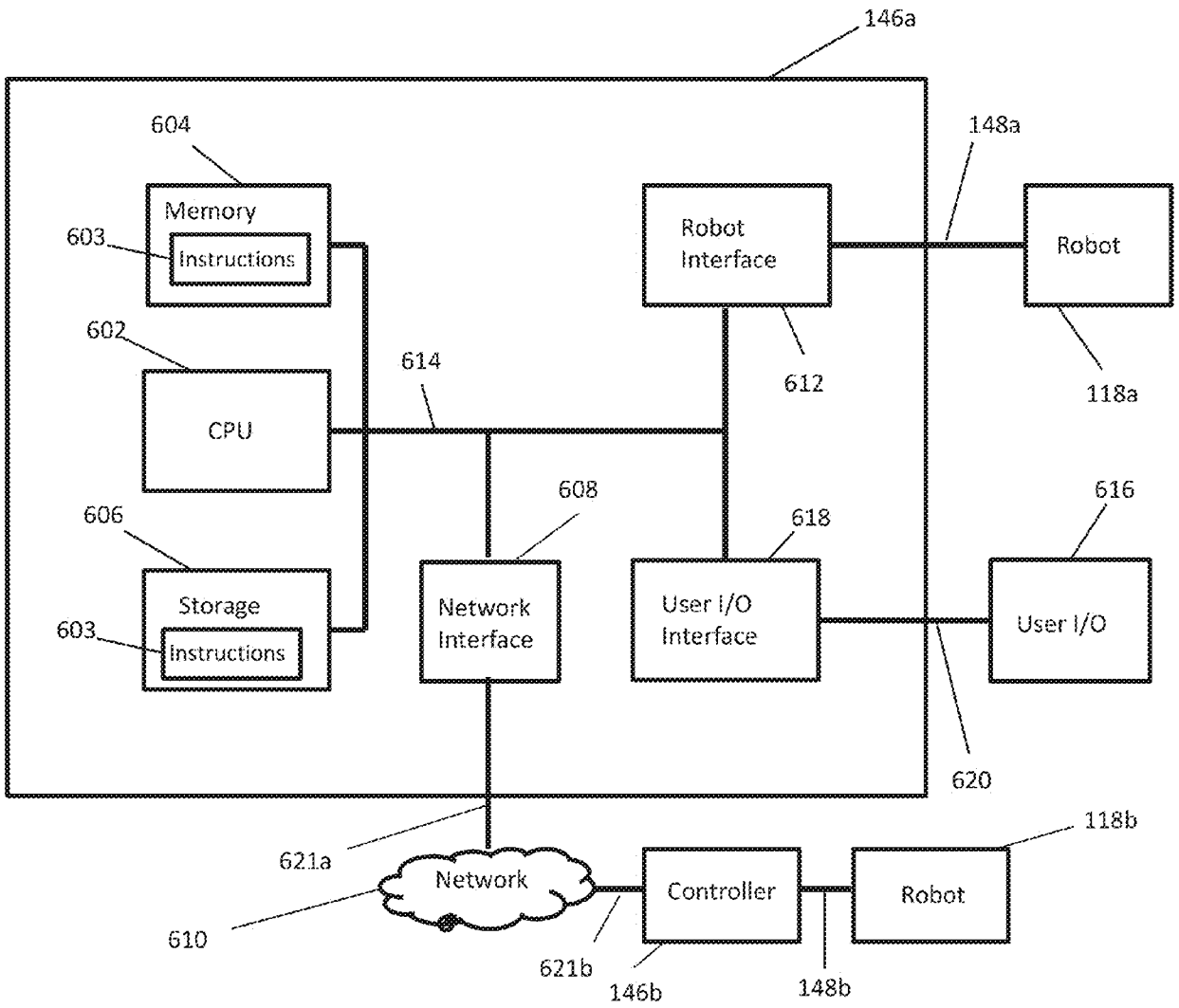
FIG. 6 illustrates a diagrammatic view of a controller 146.

With reference to FIG. 6, controller 146*a* includes a central processing unit ("CPU") 602, non-transient computer storage media such as random access memory ("RAM") 604 and hard drive storage 606 that can include one or more solid state and magnetic hard drives, for examples. The CPU 602 executes instructions 603 stored on non-transient computer storage media, such as one or both of the RAM 604 and storage 606. The instructions 603 written on one or both of the RAM 604 and storage 606 are written in a suitable computer-readable programming language such as the C programming language, or a programming language written for use with robots, such as the RAPID programming code, made available by ABB, Inc. In addition, planning and programming of automated processes can be performed by use of software such as RobotStudio® which permits loading of three-dimensional models of the workpiece (e.g., CAD representations of the workpiece), into RobotStudio® and programming and simulating the robot processes within RobotStudio®.

The controller 146*a* is connected to robot 118*a* through electrical connection 148*a*, such as one or more cables. A robot interface 612 manages communication between the robot 118*a* and controller 146*a*, transmitting electrical signals and optionally operating power to the robot 118*a*. According to one aspect of the present teachings, upon execution of the instructions 603 stored on at least one of the RAM 604 or storage 606 by the CPU 602, the CPU 602 provides signals to the robot interface 612 through the bus 614 that cause to the robot interface 612 to communicate signals to the robot 118*a* though connection 148*a*. The signals provided by robot interface 612 in turn cause the robot 118*a* to move and dispense coating as directed by the CPU 602. The robot interface 612 can, for example, cause the robot 118*a* to move to a particular position or move with a particular velocity along a determined path. According to one aspect of the present teachings, the controller 146*a* can cause the robot 118*a* having a coating dispenser 128*a* as shown in FIG. 1 to undertake motion wherein the robot 118*a* follows a particular path with a predefined velocity and with the coating dispenser 128*a* oriented toward the workpiece 104 in a direction defined by a set of coordinates corresponding to the degrees of freedom of the robot 118*a*. The path thus includes information about each of the degrees of freedom of the robot 118*a*. Where the robots each have six degrees of freedom, the path taken by the robot 118*a* and dispenser 128*a* can be represented by $\Phi_k$, where k=1 to 6, accounting for the 6 degrees of freedom. It should be noted that robots having less than or more than six degrees of freedom is possible. Additional degrees of freedom, such as 7, 8, 9 or more, are possible by, for example, including additional joints to the robot. Less degrees of freedom may compromise the flexibility afforded by robots having 6 degrees of freedom. For example, having 5 or 4 degrees of freedom can be implemented where 6 degrees of freedom are not requires due to, for example, the shape of the workpiece not requiring movement of the dispenser while coating the workpiece.

A user input/output (I/O) 616 such as a keyboard or remote control can be used to input instructions 603 into controller 146*a*. The user I/O 616 communicates with the user I/O interface 618 through connection 620. The user I/O 616 can be used to input instructions 603 into the controller 146*a*. According to one aspect of the present teachings, the user I/O 616 can be used to input a travel path, which can be defined by the coordinates $\Phi_k$, where k=1 to 6 accounting for the 6 degrees of freedom, that will be followed by the robots 118*a,b* during the coating process, a speed and coating flow rate along the path $\Phi_k$, k=1 to 6, and storing the path, speed and flow rate to at least one of the RAM 604 or storage 606. According to another aspect of the present teachings, the RAM 604 or storage 606 can have instruction 603 written upon them to execute coating processes described herein with regard to FIGS. 7 and 9. It should be noted that the aspects of controller 146*a* described herein can be distributed, such as by providing computing resources and memory through a computer workstation, and providing the robot interface within a separate unit that communicates with the workstation through a communication linkage such as a wireless connection or suitable cabling.

Several coating process parameters can be stored in the controller, and can be adjusted by, for example, accessing the user I/O 616. Such parameters include but are not limited to robot speed, the overall path of the robot and orientation of the dispenser relative to the workpiece surface, paint or coating material flow rate, coating spray pattern and shape, level of electrical potential between applicator and workpiece and blending constraints.

A network interface 608 permits connection between controller 146*a* and a network 610 through physical connection 621*a*, such as an Ethernet connection. It should be noted that wireless connections can also be implemented instead of or in addition to physical connection 621*a*. Additional controller 146*b* is also connected to the network 610 though connections 621*b* allowing the controllers 146*a,b* to be in communication and further allowing the controllers 146*a,b* to synchronize the actions of robots 118*a,b* during application of coating on a workpiece 104. It should be noted that the aspects of controllers 146*a,b* described herein can be distributed, such as by providing computing resources and memory through a computer workstation, and providing the robot interface within a separate unit that communicates with the workstation through a communication linkage such as a wireless connection or suitable cabling.

Figure 7:
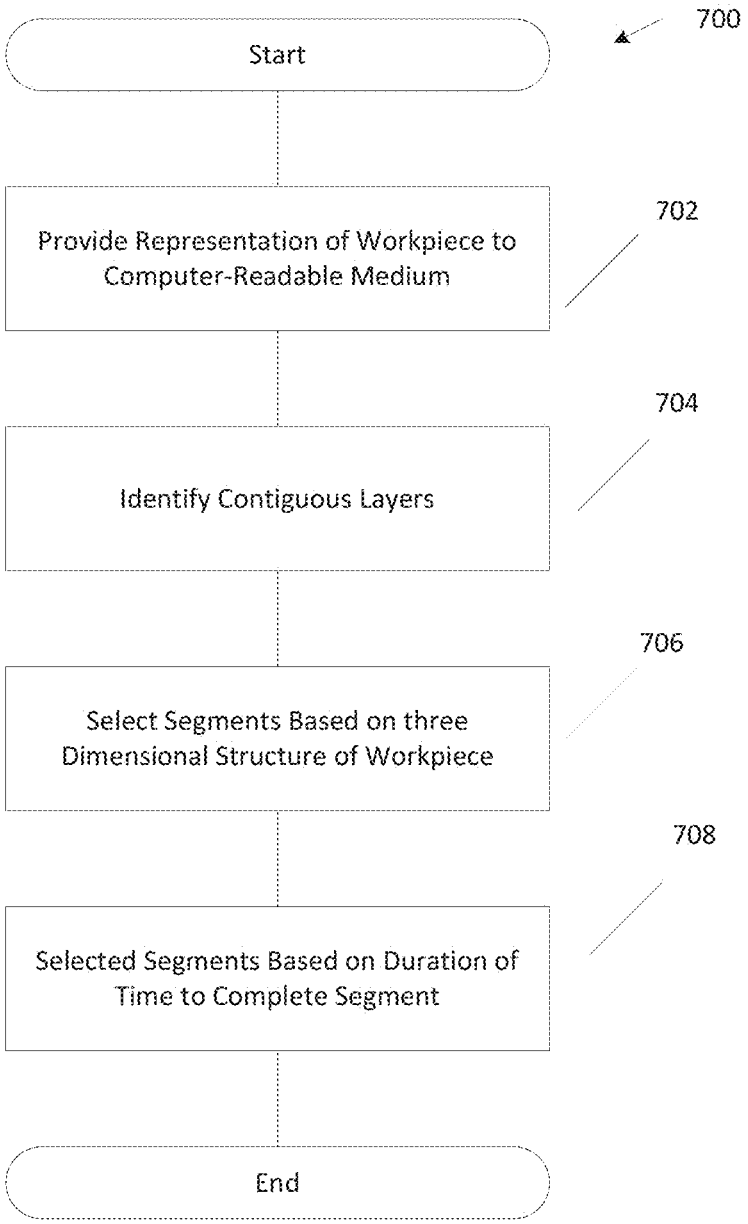
FIG. 7 illustrates steps of a method 700 of segmenting a workpiece.

The method 700 shown in FIG. 7 can automatically determine the location, shape and size of segments of a workpiece to be coated according to the teachings herein. In step 702, a computer-readable representation of the workpiece 104, such as a 3-D CAD model is provided to a computer readable medium such as memory 604 or storage 606 accessible to a processor 602. The workpiece 104 has a surface area requiring one or more layers of coating. In step 704, contiguous areas on the workpiece 104 model requiring the same coating layers are identified. Qualities of the coatings between any two surface areas that can be considered in determining whether the two coatings are the same are the order and relative position of the layer among the other layers, if any, in the aggregate coating and the thickness and the composition of the layers of coating. Other qualities can also be considered, such as any requirements that the layer of coating be applied differently, even if the thickness and the composition of layers are otherwise identical. As one example, with reference to FIGS. 4 and 5, segments 400, 402 would be identified as within separate contiguous areas as each has a different aggregate coating. Portions of any particular contiguous surface area can be treated similarly to any other portion within the same contiguous surface area. Such contiguous areas represent at least one segment 350, and can be further divided into segments 350 as provided herein.

In step 706 the three-dimensional structures of the workpiece 104, such as when the surface of the workpiece 104 transitions from a flat surface to a protrusion such as pylons 340, flap track fairings 342, 343 or other contours shown in FIG. 3 are considered in selecting segments 350. Such three dimensional structures can be selectively included within a particular segment 350, can serve as a feature separating segments 350 or may form a segment 350 by themselves.

Segments 350 can also be chosen based in part on other parameters that can differ between adjacent coated surfaces of the workpiece 104, such as occurs when the drying times of a particular layer between two adjacent surfaces differs, even if the complete sequence of coating layers is otherwise identical in its composition and thickness. In step 708, the contiguous areas are further divided into areas based on the time required to complete application of at least one of the layers of coating over the particular area and the required wet-surface time duration $T_{WET}$. If the calculated time required to complete a segment 350 is greater than the calculated wet-surface time duration for any portion of the segment 350, the segment 350 can be changed (e.g., reduced in size) to reduce the time required to complete the layer within the segment 350 to be less than the wet-surface time.

A determination of the wet-surface time duration for a layer of coating can be calculated based on one or more of the chemical composition of the layer of coating, the ambient temperature, atmospheric pressure and humidity, the temperature of the workpiece, the thickness of the layer of coating and other factors. Wet-surface time durations can also be predetermined values for ranges of various coating layer characteristics such as thickness and atmospheric conditions.

According to one aspect of the present teachings, the wet-surface time can be calculated based on a characteristic drying time. Such a predetermined characteristic drying time can reflect the drying time for a coating over a range of layer thicknesses and atmospheric conditions. Within those ranges, the wet-surface time can simply be the characteristic drying time. Such a time value can be adjusted when the variables on which the drying time of a surface depends vary greatly from the range of values for which the wet-surface time is the characteristic time. As one example, if the coating process takes place at high altitude where pressure is much lower than the range over which the characteristic drying time is applicable, the wet-surface time can be determined by subtracting a predetermined amount of time from the characteristic time. The amount of time subtracted in turn depends on the amount by which the pressure varies from the normal pressure range. Similar application can be made with other parameters, such as temperature, layer thickness and others parameters. $T_{WET}$ can also be determined by a computer processor such as processor 602 calculating the wet-surface time based on $T_{WET}$ written as a numerical function dependent on one or more of the parameters referred to herein, such as ambient temperature, atmospheric pressure and humidity, the temperature of the workpiece, the thickness of the layer of coating and other factors.

By determining the wet-surface time duration $T_{WET}$ for a location on the workpiece 104 on which a layer of coating is applied and the time at which that layer was applied at the location, the point in time at which the wet-surface time $T_{WET}$ will expire for that location can be calculated. By determining this point in time, a robot 118 can be positioned in sufficient time to begin to apply the second layer atop the first layer before the first layer becomes excessively dry.

Figure 8:
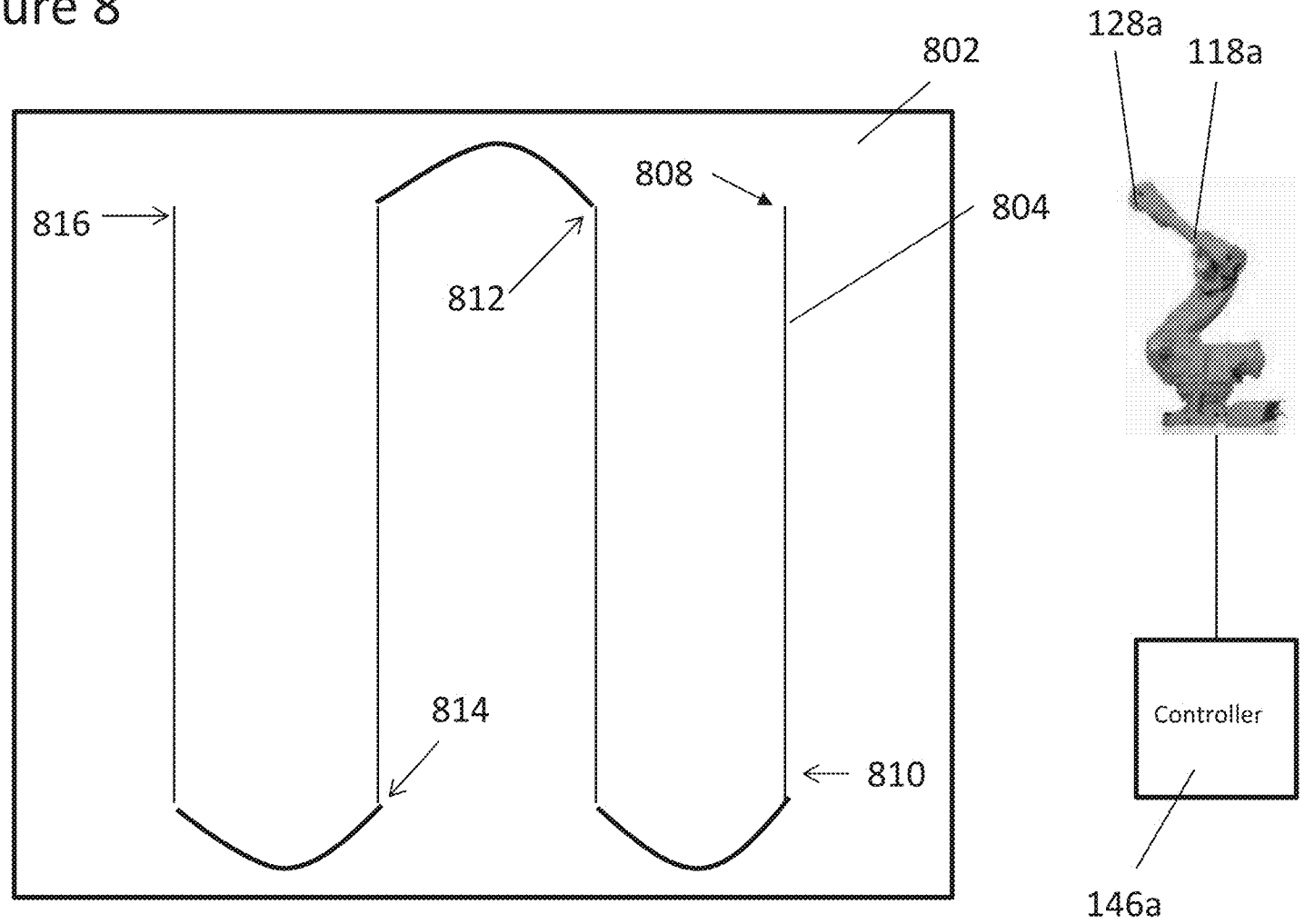
FIG. 8 illustrates a path 804 followed by a robot 800 applying coating to workpiece surface 802.

With reference to FIG. 8 a robot 118*a* applying coating to workpiece surface 802 according to the present teachings can follow path 804, which can be stored in the controller 146*a* that controls coating dispensing robot 118*a*. At time $T_0$, the painting process begins at 808. At time $T_1$ the applicator 128*a* reaches portion 810, at time $T_2$ the applicator 128*a* reaches portion 812, at time $T_3$ the applicator 128*a* reaches portion 814 and at time $T_4$ the applicator 128*a* reaches portion 816. If the wet-surface time duration is substantially greater than $T_4-T_0$, then the robot 118*a* can complete coating the entire surface 802 prior to the wet-surface time duration elapsing for any of the coating applied to surface 802, including the coating applied at portion 808, for which the wet-surface time will elapse first.

With continued reference to FIG. 8, if the wet surface time is less than $T_4-T_0$, the wet-surface time duration elapses for the coating applied to portion 808 at least prior to the robot 118*a* reaching portion 816. If a second layer coating is to be applied to the surface 802 while the initial coating is still sufficiently wet, i.e. before the wet-surface time duration elapses for any of the surface 802, then such a second layer should be applied to any such portion prior to the wet-surface time elapsing for those portions of surface 802. In one example, if the wet-surface time for portion 808 elapses prior to the time $T_1$ when the layer of coating is applied to portion 810, i.e., if the wet-surface time is less than $T_1-T_0$, then the second layer should be applied to portion 808 prior to completing the first layer of coating of portion 810. Similarly, if the wet-surface time for portion 808 elapses prior to the time $T_2$ when the layer of coating is applied to portion 812, i.e., if the wet-surface time is less than $T_2-T_0$, then the second layer should be applied to portion 808 prior to completing the first layer of coating of portion 810.

The controller 146*a* can track the time at which a layer of coating is applied over a particular portion of the workpiece surface 802, and the wet-surface time for the portions if the surface 802. For example, the controller 146*a* can record such information in real-time on a non-transient computer-readable medium. According to one aspect of the present teachings, the controller 146*a* tracks the duration of time coating has been applied over part or all of the workpiece surface 802. Such a surface can include a subsection of a workpiece 104 such as the segments 350 chosen in process 700 described herein in connection with FIG. 7. The controller 146*a* can also record the thickness of the material applied over all or part of the workpiece surface 802 and the material applied.

According to another aspect of the present teachings, the controller 146*a* also determines the time required to prepare the robot 118*a* to apply a second or subsequent layer of coating. Such a time interval can be incorporated into the calculation of when to begin instructing the robot 118*a* to apply the second layer of coating. Such time can include but is not limited to the time required to move robot 118*a* into the desired position from its current position and the time required to switch the coating being applied by the robot 118*a*, if necessary. With reference to FIG. 8, if the time required to return robot 118*a* into position to begin applying a second layer of coating on workpiece surface 802 is denoted $\Delta T$, and the wet-surface time is less than $(T_1-T_0)+\Delta T$, then in order to apply the second coating layer prior to the wet-surface time elapsing, the second layer should be applied to portion 808 prior to completing the first layer of coating of portion 810 which occurs at time $T_1$.

According to another aspect of the present teachings, multiple robots such as robot 118*a* can be implemented so that when a wet-surface time duration is elapsing for a particular portion of a workpiece surface 802 before the first layer is completely applied, a second robot 118*b* can begin to apply a second layer of coating while the first robot 118*a* is completing the first layer of coating. In this way, the first robot 118*a* need not interrupt the application of the first layer of coating in order for the second layer of coating to be applied while a wet-surface is present.

Figure 9:
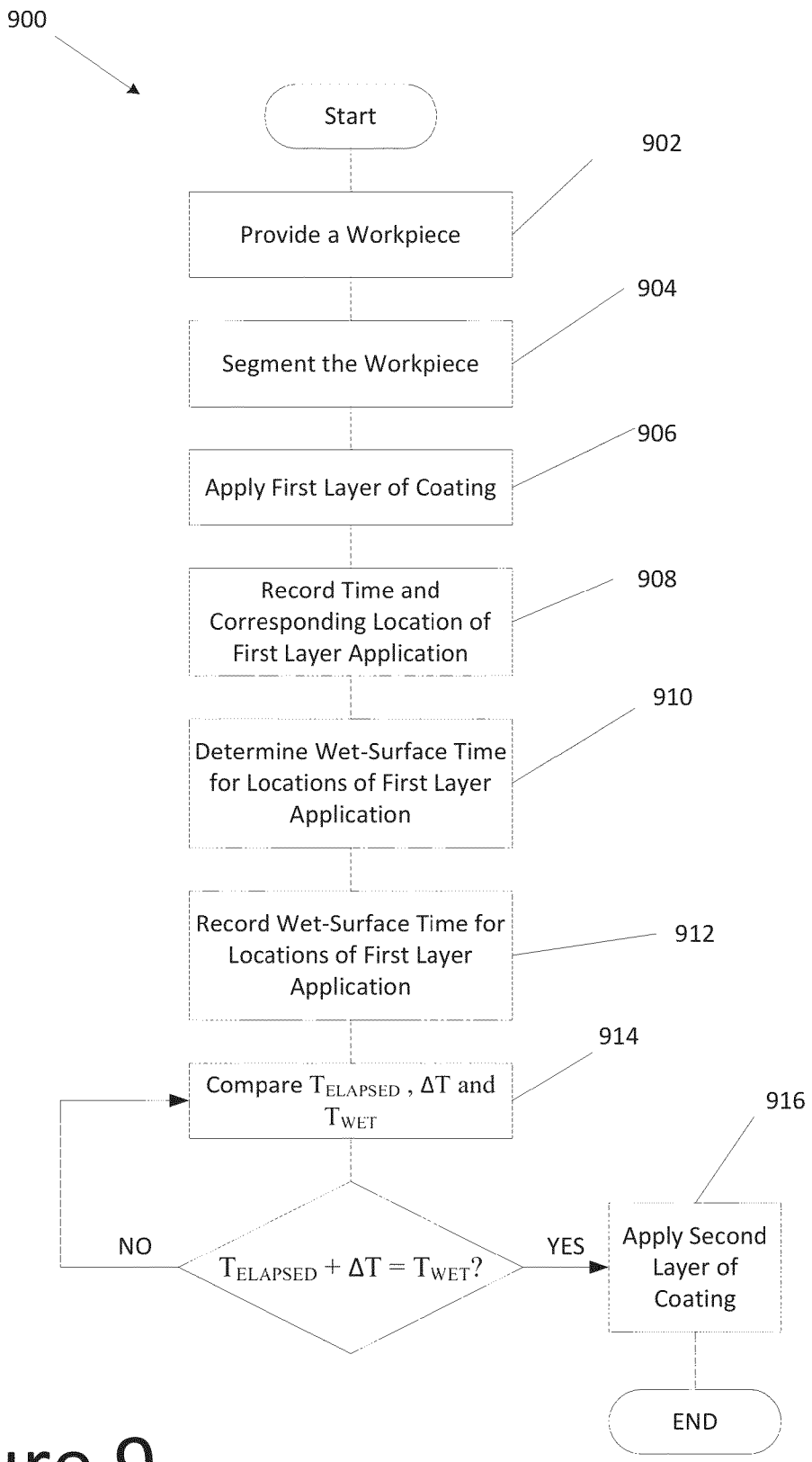
FIG. 9 illustrates steps of a method 900 of coating a workpiece.

With reference to FIG. 9, a method 900 of coating a workpiece 104 includes the step 902 of providing a workpiece 104. In step 904, the workpiece 104 is segmented into at least one segment 350 upon which coating is to be applied, such as done in method 700 referred to herein and in connection with FIG. 7. In step 906, a dispenser 128 applies a first layer of coating. In step 908, the time and corresponding location at which the first layer of coating is applied to the workpiece 104 is recorded, for example by writing such data on a non-transient computer-readable memory 604. In step 910, the wet-surface time is determined corresponding to the locations on which the first layer of coating is applied to the workpiece 104 and in step 912 such wet-surface times are recorded along with the corresponding locations. The wet-surface time can be calculated as a single value for any particular segment 350 over which a layer is to be applied.

In recording the locations on the workpiece where the first layer of coating is applied to the workpiece in step 908 or recording wet-surface times and corresponding locations in step 910, the location can be recorded as the position along the travel path of the coating dispenser, such as path 804 referred to herein and in connection with FIG. 8. In another aspect of the present teachings, the location can be recorded as a position and orientation of the dispenser along a three-dimensional coordinate space overlapping with the volume in which the workpiece is disposed.

With continued reference to FIG. 9, a comparison of the time elapsed after the application of the first layer at a particular location, denoted $T_{ELAPSED}$, the time required to provide a dispenser able to start applying a second layer of coating on the first layer at the particular location, denoted $\Delta T$, and the wet-surface time, denoted $T_{WET}$, is performed in step 914 such that if $T_{ELAPSED}+\Delta T=T_{WET}$, a dispenser 128 begins to apply the second layer of coating at the particular location for which $T_{ELAPSED}+\Delta T$ has reached $T_{WET}$.

The method 900 can be performed with one or more robotic coating dispensers 128. When a single robot 118*a* is implemented according to the present teachings, the robot 118*a* applies the first layer of coating until the first layer is completed or $T_{ELAPSED}+\Delta T=T_{WET}$. At such a point in time, the robot 118*a* can cease applying the first layer and start to apply the second layer of coating once in position to do so. The inclusion of $\Delta T$ in the comparison of the wet-surface time and the elapsed time allows the robot 118*a* to begin applying the second layer of coating prior to the wet-surface time being reached. According to one aspect of the present teachings, the robot 118*a* can apply the second layer of coating by following the same path as followed while applying the first layer of coating, starting at the location where the first layer of coating was first applied. According to another aspect of the present teachings, the location on the workpiece 104 surface at which the robot 118*a* ceased to apply the first coat is recorded, allowing the robot 118*a* to continue applying the first layer of coating at a later time.

Where a second robotic coating dispenser 128*b* is available to paint the particular subsection, the second robotic dispenser 128*b* can start applying the second coating over the first coating without interrupting the first robot 118*a* in its application of the first layer of coating. Thus, at the point in time where $T_{ELAPSED}+\Delta T=T_{WET}$, the second robot 118*b* will proceed to apply the second coat once in position to do so. Alternatively, the first robot 118*a* can return to the start of the segment and begin applying the second layer of coating, and the second robot 118*b* can continue the application the first coating where the first robot left off. In another aspect of the present teachings, more than two robots 118 having coating dispensers 128 can be implemented. For example, a first robot 118 can apply a first layer of coating, a second robot 118 can apply a second layer of coating over the first, and a third robot 118 can continue to apply the first coat from where the first robot 118 left off. In yet another aspect of the present teachings, where a segment 350 requires a first and second layer of coating applied over one another such that the first layer of coating is still sufficiently wet during the application of the second layer of coating, the controller 146 can determine which robots 118 can access the area to apply a first coating, determine which robots 118 can access the area to apply a second coating, select a robot to apply the first coating from the from the first list of robots 118 and select a robot 118 to apply the second coating from the second list of robots 118.

Although the finishing operations can be performed automatically according to the present teachings, some finishing operations can be performed by human operators. As one example, human operators can override the automated coating process and control the coating dispensing robots directly. Such intervention can be necessary under circumstances, for example, where the coating dispensing robots malfunction, or where the workpiece has uncommonly intricate surfaces requiring coating.

According to yet other aspects of the present teachings, sensors are implemented that can detect the level of wetness of a particular portion of a coated surface of a workpiece 104. Such detection can be performed with infrared or other spectroscopic sensors, for example such as can be mounted to a robot 118. Such sensors can be used to detect the level of wetness of a layer of coating, particularly the uppermost layer on a portion of the workpiece 104, by detecting the spectrum emitted by the layer of coating and comparing such a spectrum with the known spectrum of the particular coating at various levels of wetness.

According to other aspects of the present teachings, the system includes detection equipment that can determine the shape of the workpiece 104. Such rendering can be performed by cameras positioned within the painting booth 102 or by cameras mounted on the robot 118 and used with, for example, image processing software that renders three-dimensional shapes based on color, level of reflection or refraction and boundary detection.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about A to B is intended to mean from about A to about B, where A and B are the specified values.

While the present disclosure illustrates various embodiments, and while these embodiments have been described in some detail, it is not the intention of the applicant to restrict or in any way limit the scope of the claimed invention to such detail. Additional advantages and modifications will be apparent to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A computer-implemented method of coating a workpiece, comprising:

establishing electronic communication between a controller having a processor and at least one robot having a coating applicator;

executing instructions with the processor that control the robot, the instructions written on a non-transient computer-readable medium;

determining, with the controller, a wet-surface time corresponding to each of a plurality of segments of the surface of the workpiece upon which a first layer of coating is to be applied;

selecting at least one segment from the plurality of segments of the workpiece based at least in part on the wet-surface time for the first layer of coating as determined by the controller, wherein the selecting step includes changing a size of the at least one segment to permit complete coating of the at least one segment with the first layer of coating prior to a last wet-surface time of any area in the at least one segment elapsing;

applying the first layer of coating to the at least one segment of said surface of the workpiece with the at least one robot; and, applying a second layer of coating to the at least one segment for which the wet-surface time has been determined by the controller with the at least one robot prior to the wet-surface time elapsing for the at least one segment.

2. The method of claim 1, further comprising:

selecting the at least one segment based at least in part on a sequence of application of coating layers of the at least one segment and a sequence of application of coating layers of at least an area of the workpiece adjacent the at least one segment.

3. The method of claim 2, wherein the selecting step is based at least in part on a thickness or composition or both of at least one of the sequence of coating layers of the at least one segment and at least one of the sequence of coating layers of the at least an area of the workpiece adjacent the at least one segment.

4. The method of claim 3, wherein the selecting step is based at least in part on a duration of time required to apply at least one of the sequence of coating layers of the at least one segment.

5. The method of claim 1, wherein the selecting step is based at least in part on a duration of time required to apply at least one of a sequence of layers of the at least one segment.

6. The method of claim 1, wherein the second layer of coating includes the same coating material as the first layer of coating.

7. The method of claim 1, wherein the second layer of coating includes a different material than the first layer of coating.

8. The method of claim 1, further comprising determining with the controller, the wet-surface time for each of the plurality of segments of the surface upon which coating is applied based upon at least a composition of the first layer of coating.

9. The coating system of claim 1, further comprising determining the wet-surface time for each of the plurality of segments of the surface upon which coating is applied based upon at least a characteristic drying time of the first layer of coating.

10. The coating system of claim 1, further comprising determining with the controller, the wet-surface time for each of the plurality of segments of the surface upon which coating is applied based upon at least one of the air temperature, atmospheric pressure, and humidity in the volume and temperature of the workpiece.

11. A method of coating a workpiece, comprising:

determining, with a controller, a wet-surface time corresponding to each of a first segment and a second segment of a surface of the workpiece upon which a layer of coating is to be applied;

selecting the first segment of the surface of the workpiece based at least in part on the wet-surface time for the layer of coating determined by the controller, wherein the selecting step includes changing a size of the first segment to permit complete coating of the first segment with the layer of coating prior to a last wet-surface time of any area in the first segment elapsing;

automatically dispensing, with at least one robot a first coating layer over the first segment and the second segment of an artifact, the first coating layer having an average thickness over the first segment and a thickness that tapers so that an average thickness over at least an area of a boundary region of the first segment and a boundary region of the second segment is less than the average thickness over the first segment; and, automatically dispensing with the at least one robot a second coating layer over the second segment of the artifact before the wet-surface time for the first segment, the second coating layer having an average thickness over the second segment and tapers so that a reduced thickness less than the average thickness over the second segment extends over at least an area of the boundary region of the first segment and the boundary region of the second segment.

12. The method of claim 11, wherein a first robot performs the step of automatically dispensing the first coating layer, and a second robot performs the step of automatically dispensing the second coating layer.

13. The method of claim 11, wherein the first coating layer includes different coating material than the second coating layer.

14. The method of claim 13, wherein a first robot performs the step of automatically dispensing the first coating layer, and a second robot performs the step of automatically dispensing the second coating layer.

15. The method of claim 11, further comprising:

automatically dispensing with the at least one robot a third coating layer over the first segment of the artifact, the third coating layer having an average thickness over the first segment and an average thickness over at least an area of the boundary region of the first segment and the boundary region of the second segment less than the average thickness of the third coating layer over the first segment and wherein the step of automatically dispensing a first coating layer over a first segment of an artifact is performed prior the step of automatically dispensing a second coating layer over the second segment of the artifact and the step of automatically dispensing a third coating layer over the first segment of the artifact.

16. The method of claim 15, further comprising:

automatically dispensing with the at least one robot a fourth coating layer over the second segment of the artifact, the fourth coating layer having an average thickness over the second segment and an average thickness over at least an area of the boundary region of the first segment and the boundary region of the second segment less than the average thickness of the fourth coating layer over the second segment and wherein the step of automatically dispensing a fourth coating layer is performed after the step of automatically dispensing a third coating layer over the segment of the artifact.

* * * * *